US009017045B2

(12) United States Patent
Kinoshita et al.

(10) Patent No.: US 9,017,045 B2
(45) Date of Patent: Apr. 28, 2015

(54) INVERTER COVER FOR MOTOR-DRIVEN COMPRESSOR

(75) Inventors: Yusuke Kinoshita, Kariya (JP); Shingo Enami, Kariya (JP); Ken Suitou, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 533 days.

(21) Appl. No.: 13/417,697

(22) Filed: Mar. 12, 2012

(65) Prior Publication Data

US 2012/0237376 A1 Sep. 20, 2012

(30) Foreign Application Priority Data

Mar. 16, 2011 (JP) ..... 2011-058100

(51) Int. Cl.

| | |
|---|---|
| ***F04B 35/04*** | (2006.01) |
| ***F04C 23/00*** | (2006.01) |
| ***F01C 21/10*** | (2006.01) |
| ***F04B 39/12*** | (2006.01) |

(52) U.S. Cl.

CPC ..... *F04C 23/008* (2013.01); *F01C 21/10* (2013.01); *F04B 35/04* (2013.01); *F04B 39/121* (2013.01); *F04C 2240/808* (2013.01); *F05C 2201/021* (2013.01)

(58) Field of Classification Search

USPC ..... 62/228.4; 417/410.1, 423.7, 423.14

See application file for complete search history.

(56) References Cited

U.S. PATENT DOCUMENTS

| | | | | |
|---|---|---|---|---|
| 5,045,026 | A * | 9/1991 | Buse | 464/29 |
| 5,456,158 | A * | 10/1995 | Ikeda et al. | 92/71 |
| 5,785,013 | A * | 7/1998 | Sinn et al. | 123/41.44 |
| 2003/0143056 | A1 | 7/2003 | Miura | |
| 2003/0200761 | A1 | 10/2003 | Funahashi et al. | |
| 2004/0009078 | A1 * | 1/2004 | Kimura et al. | 417/410.5 |
| 2004/0108779 | A1 * | 6/2004 | Boettger et al. | 310/89 |
| 2005/0223727 | A1 | 10/2005 | Funahashi et al. | |
| 2006/0064998 | A1 | 3/2006 | Funahashi et al. | |
| 2007/0035272 | A1 | 2/2007 | Hattori et al. | |
| 2010/0074772 | A1 | 3/2010 | Hoshino et al. | |
| 2010/0183457 | A1 | 7/2010 | Hattori et al. | |

FOREIGN PATENT DOCUMENTS

| | | | |
|---|---|---|---|
| CN | 100520064 | C | 7/2009 |
| JP | 2002-155862 | A | 5/2002 |
| JP | 2003-222109 | A | 8/2003 |
| JP | 2003-260992 | A | 9/2003 |
| JP | 2003-322082 | A | 11/2003 |
| JP | 2004-162618 | A | 6/2004 |
| JP | 2008-215236 | A | 9/2008 |
| JP | 2009-156213 | A | 7/2009 |

* cited by examiner

*Primary Examiner* — Devon Kramer
*Assistant Examiner* — Patrick Hamo
(74) *Attorney, Agent, or Firm* — Sughrue Mion, PLLC

(57) ABSTRACT

An electric compressor includes an inverter cover. The inverter cover has a metal plate that is arranged to cover an inverter (a circuit board). The metal plate has bolt insertion holes, through which metal bolts for fixing the inverter cover to a suction housing are passed. The head of each bolt contacts a flange portion, which is the periphery of the corresponding bolt insertion hole. The inverter cover is formed of plastic by being molded in a mold, using the metal plate as a core.

9 Claims, 6 Drawing Sheets

INVERTER COVER FOR MOTOR-DRIVEN COMPRESSOR

BACKGROUND OF THE INVENTION

The present invention relates to an electric compressor.

An electric compressor includes a compressing portion for compressing and discharging refrigerant, an electric motor for driving the compressing portion, and a housing for accommodating the compressing portion and the electric motor. An inverter cover, which accommodates an inverter for driving the electric motor, is fixed to the housing. If made of metal, the inverter cover increases the weight of the electric compressor. Thus, to minimize the increase in the weight of the electric compressor, the weight of the inverter cover may be reduced, for example, by making the inverter cover with plastic. For example, refer to Japanese Laid-Open Patent Publication No. 2004-162618 (a first prior art) and Japanese Laid-Open Patent Publication No. 2002-155862 (a second prior art).

The electric compressor of the first prior art has an inverter case (inverter cover). The inverter case includes a base portion, which is formed integrally with the motor housing on the outer circumferential surface of the motor housing, a frame portion placed on a base surface of the base portion, and a lid portion for closing the upper opening of the frame portion. A part of the inverter case, or a frame portion, is formed of plastic.

The inverter case of the second prior art has a main body, which is made of plastic. Metal plating is applied to the inside of the inverter case, for example, through insert molding.

However, in the inverter case of the first prior art, external electromagnetic noise can intrude from the frame portion and flow into the inverter. Also, in the inverter case of the second prior art, the metal plating cannot ensure the strength of the inverter case. Further, due to changes in the temperature in the engine compartment, where the compressor is placed, the difference in the rate of the thermal expansion between the metal and the plastic can cause the metal plating to peel off the inverter case. In such a case, the metal plating can no longer shield against external electromagnetic noise. Also, a peeled flake of the metal plating can contact the inverter, causing short circuiting.

SUMMARY OF THE INVENTION

Accordingly, it is an objective of the present invention to provide an electric compressor that maintains the strength of an inverter cover while reducing the weight of the inverter cover, and prevents external electromagnetic noise from flowing into an inverter.

To achieve the foregoing objective and in accordance with one aspect of the present invention, an electric compressor is provided that includes a metal housing, a compressing portion and an electric motor accommodated in the housing, an inverter for driving the electric motor, and an inverter cover fixed to the housing. The inverter cover accommodates the inverter. The inverter cover has a metal plate that is arranged to cover the inverter. The metal plate has a bolt insertion hole for fixing the inverter cover to the housing. When the inverter cover is fixed to the housing by a metal bolt having a head and a threaded portion, the threaded portion of the bolt is passed through the bolt insertion hole, and the head of the bolt and the periphery of the bolt insertion hole are electrically connected to each other. The inverter cover is formed of plastic by being molded in a mold, using the metal plate as a core.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

One embodiment of the present invention will now be described with reference to FIGS. 1A to 4.

Figure 1A:
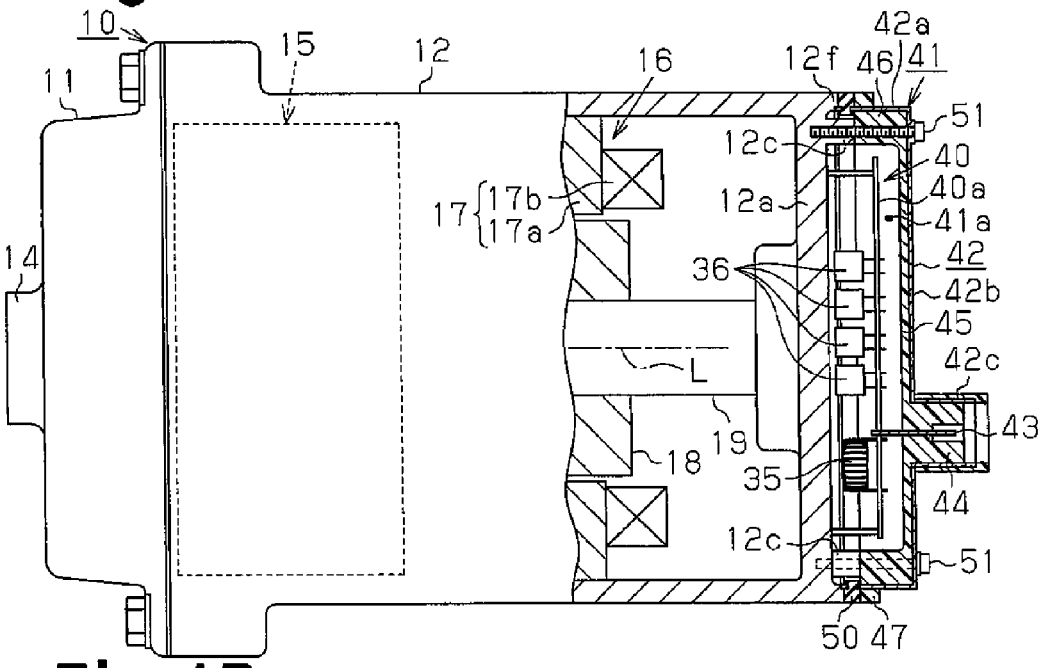
FIG. 1A is a cross-sectional view, with a part cut away, illustrating an electric compressor according to one embodiment of the present invention.

As shown in FIG. 1A, a housing of an electric compressor 10 is formed by a discharge housing member 11 located on the left as viewed in FIG. 1A and a suction housing member 12 secured to the discharge housing member 11. The discharge housing member 11 and the suction housing member 12 are made of aluminum, that is, metal, and formed as a cylinder with one end closed. A suction port is formed in the bottom of the circumferential wall of the suction housing member 12. The suction port is connected to an external refrigerant circuit (not shown). A discharge port 14 is formed on the lid side, or the left side as viewed in FIG. 1A, of the discharge housing member 11. The discharge port 14 is connected to the external refrigerant circuit. The suction housing 12 accommodates a compressing portion 15 for compressing refrigerant (shown by a broken line in FIG. 1A) and an electric motor 16 for driving the compressing portion 15. Although not illustrated in the present embodiment, the compressing portion 15 is formed by a stationary scroll fixed to the suction housing 12 and a movable scroll arranged to face the fixed scroll.

A stator 17 is fixed to the inner circumferential surface of the suction housing member 12. The stator 17 has a stator core 17*a* fixed to the inner circumferential surface of the suction housing member 12. The stator core 17*a* has teeth (not shown) around which coils 17*b* are wound. A rotary shaft 19 extends through the stator 17 and is rotationally supported in the suction housing member 12. A rotor 18 is fixed to the rotary shaft 19.

Figure 1B:
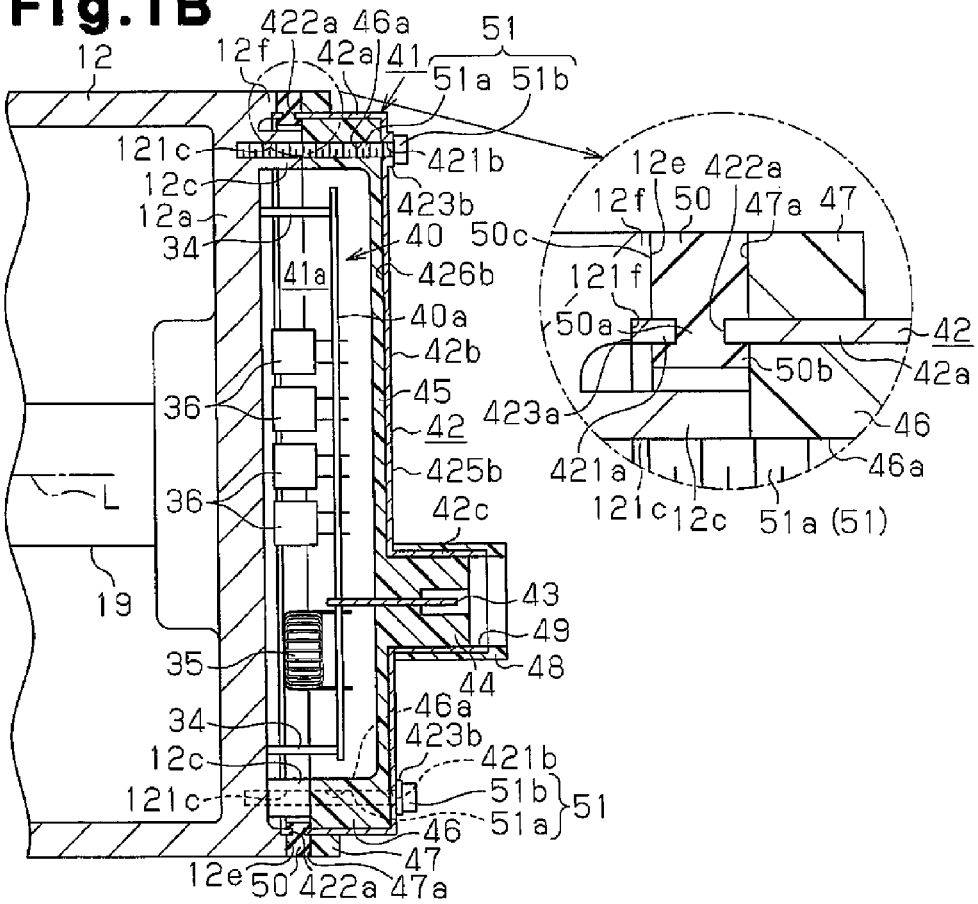
FIG. 1B is an enlarged cross-sectional view illustrating the inverter cover and its surroundings.
Figure 2:
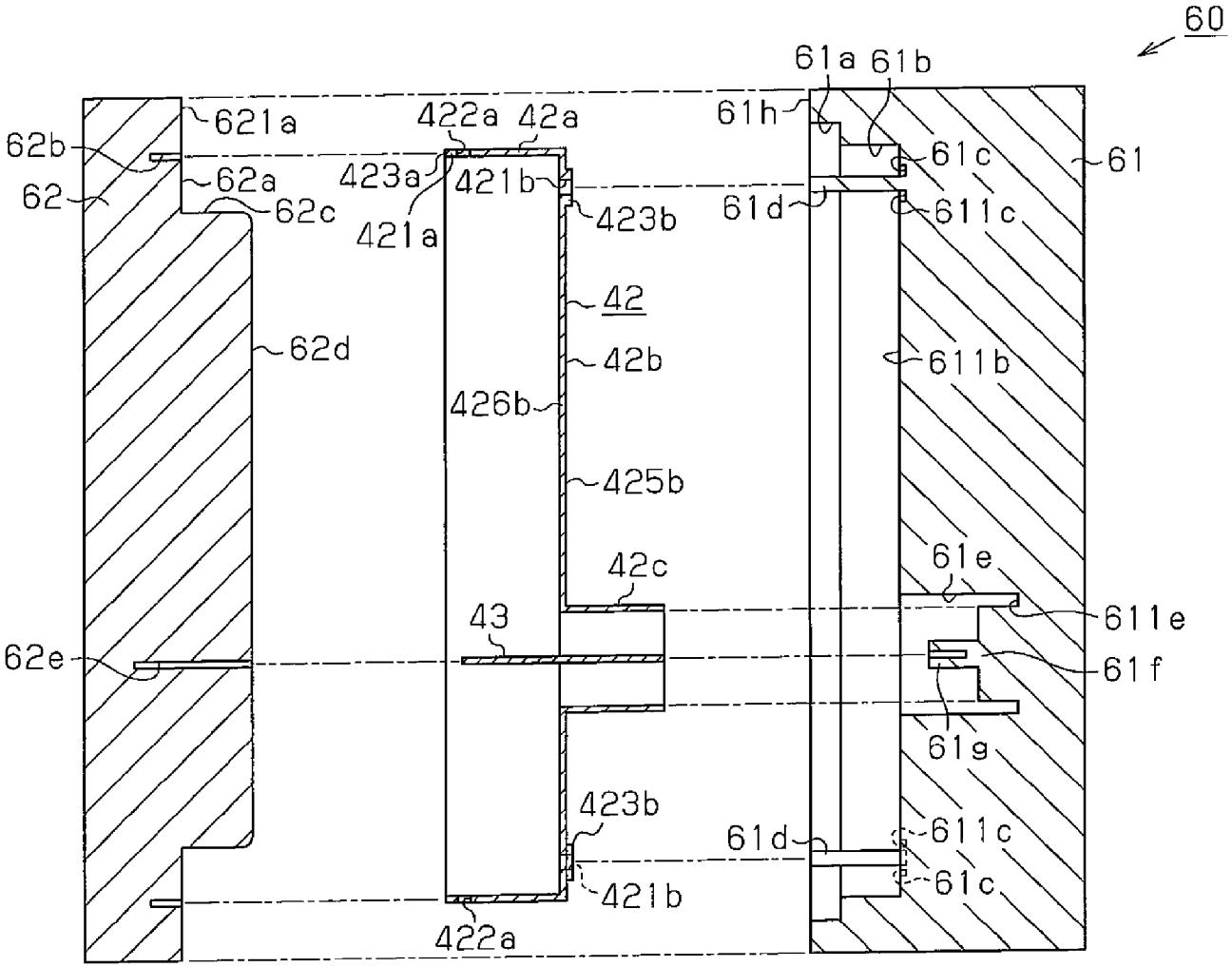
FIG. 2 is a cross-sectional view illustrating a metal plate, a metal terminal, a first mold member, and a second mold member.

As shown in FIG. 1B, the suction housing member 12 has a bottom wall 12*a* (on the right side as viewed in FIG. 1B). An annular rim 12*f* extends outward from the entire outer circumference of the bottom wall 12*a* in the axial direction, in which the axis L of the rotary shaft 19 extends. A plurality of attaching cylinders 12*c* (two of them are shown in FIG. 2) protrude from the bottom wall 12*a*. An internal thread hole 121*c* is formed inside each attaching cylinder 12*c*. An inverter cover 41 with one end opened is fixed to the open end of the rim 12*f*. The bottom wall 12*a*, the rim 12*f*, and the inverter cover 41 define an accommodation space 41*a*. The accommodation space 41*a* accommodates an inverter 40.

A circuit board 40*a* of the inverter 40 is supported by the bottom wall 12*a* via board supporting members 34 fixed to the bottom wall 12*a*, while being separated from the bottom wall 12*a*. The circuit board 40*a* is accommodated in the accommodation space 41*a* such that the mounting surface of the circuit board 40*a* is perpendicular to the axial direction of the rotary shaft 19. Therefore, in the present embodiment, the compressing portion 15, the electric motor 16, and the inverter 40 are arranged in order along the axial direction of the rotary shaft 19.

The circuit board 40*a* mounts a drive control circuit for the electric motor 16, or an inverter circuit. The circuit board 40*a* is electrically connected to switching elements (not shown), a filter coil 35, and capacitors 36. The filter coil 35 and the capacitors 36 are mounted on the circuit board 40*a*, while being separated from the bottom wall 12*a*.

Electricity is supplied to the electric motor 16 after being controlled by the inverter 40. This rotates the rotary shaft 19 together with the rotor 18 at a controlled rotational speed. Accordingly, the compressing portion 15 is operated. As the compressing portion 15 operates, refrigerant is drawn into the suction housing member 12 from the external refrigerant circuit through the suction port. The refrigerant is then compressed by the compressing portion 15, and the compressed refrigerant is discharged to the external refrigerant circuit via the discharge port 14.

The inverter cover 41 will now be described in detail.

The inverter cover 41 has a metal plate 42 made of aluminum. The metal plate 42 serves as the framework of the inverter cover 41. The metal plate 42 includes a cylindrical outer circumferential portion 42*a*, a bottom wall 42*b*, a cylindrical portion 42*c*, which forms a power input port 49. The outer circumferential portion 42*a* is annular and extends in the axial direction of the rotary shaft 19. The bottom wall 42*b* is continuous with the outer circumferential portion 42*a* and extends in a direction perpendicular to the direction of the outer circumferential portion 42*a*. The cylindrical portion 42*c* is continuous with the bottom wall 42*b* and extends in the axial direction of the rotary shaft 19. The metal plate 42 is arranged to cover the circuit board 40*a* of the inverter 40.

The bottom wall 42*b* has bolt insertion holes 421*b*, which are located at positions corresponding to the internal thread holes 121*c* of the attaching cylinders 12*c*. Flange portions 423*b* are formed on and protrude from an outer surface 425*b* of the bottom wall 42*b*. Each flange portion 423*b* is formed to surround one of the bolt insertion holes 421*b*. That is, with the flange portions 423*b*, the thickness of the metal plate 42 at the periphery of each bolt insertion hole 421*b* is greater than the thickness of the other parts of the metal plate 42. This increases the strength of the peripheries of the bolt insertion holes 421*b*. The end face of each flange portion 423*b* is flat.

A distal end portion 421*a* of the outer circumferential portion 42*a* is located on the side facing the suction housing member 12. The distal end portion 421*a* has a plurality of sealing member attaching holes 422*a* (only two of them are shown in FIG. 1B), which are formed at predetermined intervals along the circumferential direction of the outer circumferential portion 42*a*. An annular sealing member 50 is integrally assembled with the distal end portion 421*a* of the outer circumferential portion 42*a* to seal the space between the suction housing member 12 and the inverter cover 41.

As shown in FIG. 1B in an enlarged manner, the sealing member 50 has projections 50*a*, which protrude radially inward and are arranged at predetermined intervals. Each projection 50*a* has an engaging portion 50*b*, which extends in the axial direction of the rotary shaft 19. Each engaging portion 50*b* is forcibly passed through the corresponding sealing member attaching hole 422*a*, while being elastically deformed, such that each engaging portion 50*b* is engaged with the periphery of the corresponding sealing member attaching hole 422*a*. Accordingly, the sealing member 50 is assembled integrally with the distal end portion 421*a* of the outer circumferential portion 42*a*. With the sealing member 50 attached to the distal end portion 421*a* of the outer circumferential portion 42*a*, a part of the distal end portion 421*a* of the outer circumferential portion 42*a* is covered with the sealing member 50. A distal surface 423*a* of the outer circumferential portion 42*a* protrudes further than an end face 50*c* of the sealing member 50 that faces the suction housing member 12. The distal surface 423*a* of the outer circumferential portion 42*a* contacts a recess 121*f* formed in the inner circumference of the rim 12*f*.

A plastic power connector 44, which is integrated with the cylindrical portion 42*c*, is provided inside the cylindrical portion 42*c*, which forms the power input port 49. The power connector 44 has a metal terminal 43, which is electrically connectable to an external power source (vehicle battery). The cylindrical portion 42*c* also has an integrally formed plastic insulating cover 48. The insulating cover 48 covers the outer circumferential surface and the open end of the cylindrical portion 42*c*, and extends in the entire outer circumferential surface of the cylindrical portion 42*c*. The insulating cover 48 and the cylindrical portion 42*c* form, in the inverter cover 41, the power input port 49, which expose the accommodation space 41*a* to the outside.

An inner insulating portion 45 made of plastic is located on an inner surface 426*b* of the bottom wall 42*b* and integrated with the metal plate 42 (the bottom wall 42*b*). The inner insulating portion 45 is continuous with the power connector 44 and extends from the power connector 44 and along the inner surface of the bottom wall 42*b*. Further, a plastic inner circumferential insulating portion 46 is provided on a part of the outer circumferential portion 42*a* that is closer to the bottom wall 42*b* than the distal end portion 421*a* of the outer circumferential portion 42*a*. The inner circumferential insulating portion 46 is integrated with the metal plate 42 (the outer circumferential portion 42*a*). The inner circumferential insulating portion 46 is continuous with the inner insulating portion 45 and extends along the entire inner circumferential surface of the outer circumferential portion 42*a*.

Also, a plastic outer circumferential insulating portion 47 is provided on a part of the outer circumferential portion 42*a* that is closer to the bottom wall 42*b* than the distal end portion 421*a* of the outer circumferential portion 42*a*. The outer circumferential insulating portion 47 extends along the entire outer circumferential surface of the outer circumferential portion 42*a* and is integrated with the metal plate 42 (the outer circumferential portion 42*a*). An end face 47*a* of the outer circumferential insulating portion 47 that faces the suction housing member 12 contacts an end face of the sealing member 50 that is opposite to the suction housing member 12. That is, the distal end portion 421*a* of the outer circumferential portion 42*a* is not covered with plastic. Thus, in the present embodiment, the inverter cover 41 is formed by the metal plate 42, the power connector 44, the inner insulating portion 45, the inner circumferential insulating portion 46, the outer circumferential insulating portion 47, the insulating cover 48, and the sealing member 50.

Insertion holes 46*a* are formed in the inner circumferential insulating portion 46. A threaded portion 51*a* of a metal bolt 51, which is passed through each bolt insertion hole 421*b*, is passed through each insertion hole 46*a*. After being passed through the corresponding pair of the bolt insertion hole 421*b* and insertion hole 46*a*, the distal end of the threaded portion 51*a* of each bolt 51 is threaded to an internal thread hole 121*c*. With the threaded portion 51*a* threaded to the internal thread holes 121*c*, a head 51*b* of each bolt 51 contacts and is electrically connected to the end face of the corresponding flange portion 423*b*. By threading the bolts 51 with the internal thread holes 121*c*, the inverter cover 41 is fixed to the suction housing member 12. With the inverter cover 41 fixed to the suction housing member 12, the sealing member 50 is tightly held between the end face 47*a* of the outer circumferential insulating portion 47 and an end face 12*e* of the rim 12*f*, and seals the space between the end face 47*a* of the outer circumferential insulating portion 47 and the end face 12*e* of the rim 12*f*.

As shown in FIG. 2, the inverter cover 41 is manufactured by using a molding apparatus 60, which is formed by a first mold member 61 and a second mold member 62.

The first mold member 61 has a recess 61*a*, which forms a fill space K1 (refer to FIG. 3) that is filled with plastic for forming the outer circumferential insulating portion 47. Also, the first mold member 61 has an accommodating recess 61*b*, which is continuous with the recess 61*a* and accommodates the outer circumferential portion 42*a* of the metal plate 42. A bottom surface 611*b* of the accommodating recess 61*b* contacts the outer surface 425*b* of the bottom wall 42*b* of the metal plate 42. Fitting recesses 61*c* is formed in the bottom surface 611*b* of the accommodating recess 61*b*. The fitting recesses 61*c* receive the flange portions 423*b*. A projection 61*d* is formed on a bottom surface 611*c* of each fitting recess 61*c*. The projection 61*d* is inserted into one of the bolt insertion holes 421*b*. The distal end faces of the projections 61*d* are located on the same plane as an end face 61*h* of the first mold member 61. An accommodating recess 61*e* for accommodating the cylindrical portion 42*c* is formed in the bottom surface 611*b* of the accommodating recess 61*b*. A protrusion 61*f* for forming the outer shape of the power connector 44 is provided on a bottom surface 611*e* of the accommodating recess 61*e*. The protrusion 61*f* has a holding portion 61*g* for holding a first end of the metal terminal 43.

The second mold member 62 has a surface 62*a*, which forms a contact surface 621*a* that contacts the end face 61*h* of the first mold member 61. An insertion recess 62*b* for receiving the distal end portion 421*a* of the outer circumferential portion 42*a* is formed in the surface 62*a*. The second mold member 62 has a fill space forming surface 62*c* for forming a fill space K2 (refer to FIG. 3). The fill space K2 is filled with plastic for forming the inner circumferential insulating portion 46 together with the inner circumferential surface of the outer circumferential portion 42*a*. The fill space forming surface 62*c* is continuous with the surface 62*a* and extends in a direction perpendicular to the surface 62*a*. Further, the second mold member 62 has a fill space forming surface 62*d* for forming a fill space K3 (refer to FIG. 3). The fill space K3 is filled with plastic for forming the inner insulating portion 45 together with the inner surface 426*b* of the bottom wall 42*b*. The fill space forming surface 62*d* is continuous with the fill space forming surface 62*c* and extends in a direction perpendicular to the fill space forming surface 62*c*. Also, an insertion recess 62*e*, which is recessed relative to the fill space forming surface 62*d*, is formed in the second mold member 62. A second end of the metal terminal 43 can be inserted into the insertion recess 62*e*.

Next, a method for manufacturing the inverter cover 41 according to the present embodiment, which uses the above described molding apparatus 60, will be described.

Figure 3:
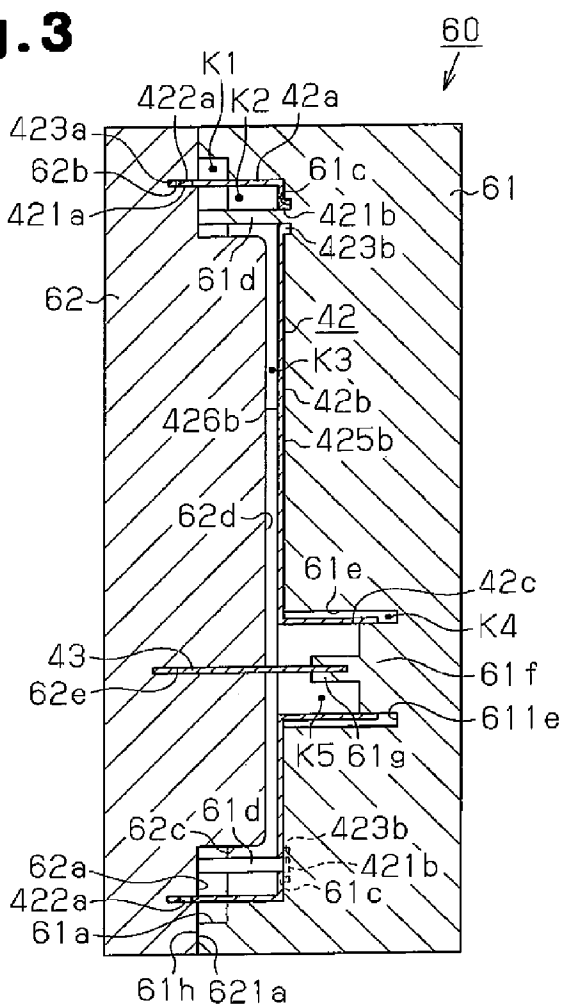
FIG. 3 is a cross-sectional view illustrating the metal plate and the metal terminal, when installed in the first mold member and the second mold member.

First, as shown in FIG. 3, the first end of the metal terminal 43 is held by the holding portion 61*g* of the first mold member 61. Subsequently, the metal plate 42 is inserted into the first mold member 61 such that the outer circumferential portion 42*a* is received in the accommodating recess 61*b*. Then, the outer surface 425*b* of the bottom wall 42*b* contacts the bottom surface 611*b* of the accommodating recess 61*b*, and each flange portions 423*b* is fitted in the corresponding fitting recess 61*c*. Also, each projection 61*d* is inserted in the corresponding bolt insertion hole 421*b*. Further, the cylindrical portion 42*c* is accommodated in the accommodating recess 61*e*, and the cylindrical portion 42*c*, the accommodating recess 61*e*, and the protrusion 61*f* define a fill space K4 to be filled with plastic for forming the insulating cover 48.

Subsequently, the second mold member 62 is arranged in relation to the first mold member 61 such that the contact surface 621*a* of the second mold member 62 contacts the end face 61*h* of the first mold member 61. Accordingly, the distal end portion 421*a* of the outer circumferential portion 42*a* is inserted into the insertion recess 62*b*, and the second end of the metal terminal 43 is inserted into the insertion recess 62*e*. The surface 62*a*, the recess 61*a*, and the outer circumferential surface of the outer circumferential portion 42*a* define the fill space K1. Further, the surface 62*a*, inner circumferential surface of the outer circumferential portion 42*a*, and the surface 62*c* define the fill space K2, and the surface 62*d* and the inner surface 426*b* of the bottom wall 42*b* define the fill space K3 in between. The inner circumferential surface of the cylindrical portion 42*c* and the protrusion 61*f* define a fill space K5 to be filled with plastic for forming the power connector 44. The fill space K2, the fill space K3, and the fill space K5 communicate with each other. With the distal end portion 421*a* of the outer circumferential portion 42*a* inserted into the insertion recess 62*b*, the sealing member attaching hole 422*a* is embedded in the insertion recess 62*b*.

Figure 4:
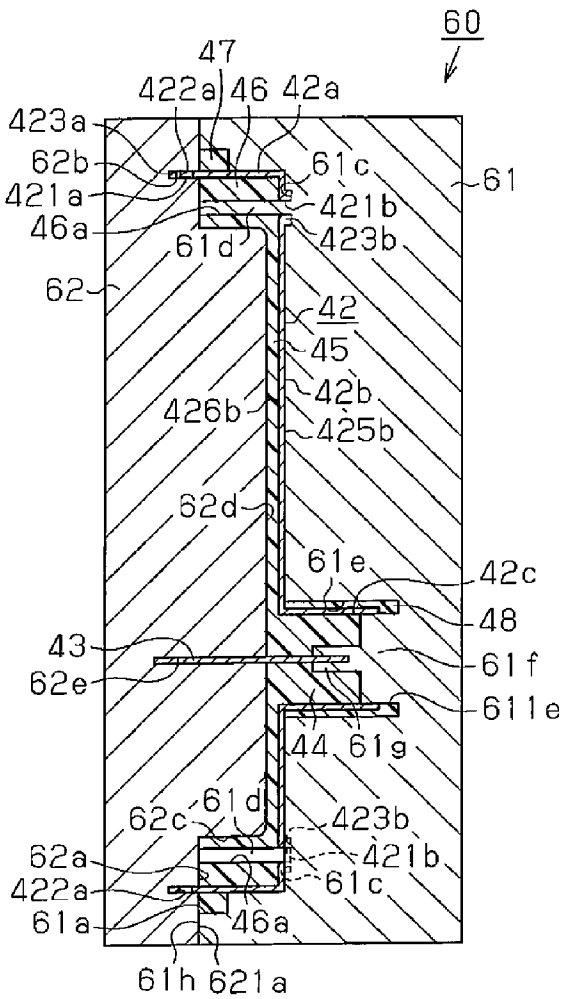
FIG. 4 is a cross-sectional view illustrating a state in which a cavity is filled with molten plastic.

Subsequently, as shown in FIG. 4, molten plastic is introduced into the fill space K1 and the fill space K4 and hardened, so that the outer circumferential insulating portion 47 and the insulating cover 48 are formed integrally with the metal plate 42 in the fill spaces K1 and K4. Molten plastic that has been introduced into the fill space K5 flows to the fill space K3 and the fill space K2 and then fills the fill space K5, the fill space K3, and the fill space K2. The filling molten plastic is hardened to form the power connector 44, the inner insulating portion 45, and the inner circumferential insulating portion 46 in a state integrated with the metal plate 42 in the fill space K5, the fill space K3, and the fill space K2. The insertion holes 46*a* are formed in the inner circumferential insulating portion 46 by the projections 61*d*. The thus manufactured inverter cover 41 is a plastic mold that is formed by a mold of plastic using the metal plate 42 as a core.

The distal end portion 421*a* of the outer circumferential portion 42*a*, which has been inserted in the insertion recess 62*b*, is not covered with the plastic but protrudes in the direction opposite to the bottom wall 42*b* from the inner circumferential insulating portion 46 and the outer circumferential insulating portion 47. Each engaging portion 50*b* is forcibly passed through the corresponding sealing member attaching hole 422*a*, while being elastically deformed, such that the engaging portions 50*b* is engaged with the periphery of the sealing member attaching hole 422*a*. Accordingly, the sealing member 50 is assembled with the distal end portion 421*a* of the outer circumferential portion 42*a*.

Operation of this embodiment will now be described.

With the inverter cover 41 having the above described configuration fixed to the suction housing member 12, external electromagnetic noise flows into the outer circumferential insulating portion 47 and the insulating cover 48 of the inverter cover 41. The external electromagnetic noise that has flowed into the outer circumferential insulating portion 47 and the insulating cover 48 is blocked by the outer circumferential portion 42*a* and the cylindrical portion 42*c* and flows to the threaded portions 51*a* of the bolts 51 via the bottom wall 42*b* and contacting parts (electric contacting parts) between the heads 51*b* of the bolts 51 and the flange portions 423*b*. The external electromagnetic noise that has flowed to the threaded portions 51*a* is grounded after flowing to the suction housing 12 via the bottom wall 12*a*. Accordingly, the external electromagnetic noise is prevented from flowing to the inverter 40.

External electromagnetic noise also flows in via the sealing member 50. The external electromagnetic noise that has flowed in via the sealing member 50 is blocked by the distal end portion 421*a* of the outer circumferential portion 42*a* and flows to the threaded portions 51*a* of the bolts 51 via the bottom wall 42*b* and contacting parts between the heads 51*b* of the bolts 51 and the flange portions 423*b*. The external electromagnetic noise that has flowed to the threaded portions 51*a* is grounded after flowing to the suction housing 12 via the bottom wall 12*a*. Accordingly, the external electromagnetic noise that has flowed to the sealing member 50 is prevented from flowing to the inverter 40.

The above described embodiment provides the following advantages.

(1) The inverter cover 41 has the metal plate 42, which is arranged to cover the inverter 40 (the circuit board 40*a*). The inverter cover 41 is formed of plastic with the metal plate 42 as the core. Since the inverter cover 41 is formed mainly of plastic and uses the metal plate 42 as the core, the weight of the inverter cover 41 is lighter than that in a case in which the entire inverter cover 41 is made of metal. Also, the metal plate 42 ensures the strength of the inverter cover 41. Further, even though the inverter cover 41 is mainly made of plastic, external electromagnetic noise is blocked by the metal plate 42 and flows to the suction housing member 12 via the contacting parts between the heads 51*b* of the bolts 51 and the flange portions 423*b*, the threaded portions 51*a* of the bolts 51, and the bottom wall 12*a*. The electromagnetic noise is then grounded. Accordingly, the external electromagnetic noise is prevented from flowing to the inverter 40.

(2) The sealing member 50 covers part of the distal end portion 421*a* of the outer circumferential portion 42*a*, and the distal surface 423*a* of the outer circumferential portion 42*a* protrudes further than the end face 50*c* of the sealing member 50, which faces the suction housing member 12. Thus, external electromagnetic noise that flows from the sealing member 50 is blocked by the distal end portion 421*a* of the outer circumferential portion 42*a* and flows to the suction housing member 12 via the contacting parts between the heads 51*b* of the bolts 51 and the flange portions 423*b*, the threaded portions 51*a* of the bolts 51, and the bottom wall 12*a*. The electromagnetic noise is then grounded. Therefore, the external electromagnetic noise from the sealing member 50 is prevented from flowing to the inverter 40. Since the distal end portion 421*a* of the outer circumferential portion 42*a* is not covered with plastic, the sealing member 50 can be assembled to the distal end portion 421*a* of the outer circumferential portion 42*a* in advance when assembling the inverter cover 41 to the suction housing member 12. This facilitates the assembly.

(3) Since the sealing member 50 is integrated with the distal end portion 421*a* of the outer circumferential portion 42*a*, the sealing member 50 can be arranged between the suction housing member 12 and the inverter cover 41 at the same time as arranging the inverter cover 41 in relation to the suction housing member 12. This further facilitates the assembly.

(4) The distal surface 423*a* of the outer circumferential portion 42*a* protrudes further than the end face 50*c* of the sealing member 50 that faces the suction housing member 12, and contacts recesses 121*f* formed in the inner circumferential edge of the rim 12*f*. Therefore, external electromagnetic noise flows to and is grounded to the suction housing member 12 via the outer circumferential portion 42*a* and the recess 121*f*. This prevents the external electromagnetic noise from flowing to the inverter 40.

(5) The inverter cover 41 has the inner insulating portion 45, which extends from the power connector 44 and along the inner surface 426*b* of the bottom wall 42*b* of the metal plate 42. Therefore, even though the space between the metal plate 42 and the inverter 40 (the circuit board 40*a*) is minimized, the inner insulating portion 45 ensures the insulation between the metal plate 42 and the inverter 40 (the circuit board 40*a*). Therefore, the space between the metal plate 42 and the inverter 40 (the circuit board 40*a*) can be reduced so that the size of the electric compressor 10 in the axial direction of the rotary shaft 19 can be reduced.

(6) In the present embodiment, molten plastic is introduced into the fill space K5, so that the molten plastic flows into the fill space K3, which communicates with the fill space K5. The molten plastic that fills the fill space K3 is hardened to form the inner insulating portion 45 on the inner surface 426*b* of the bottom wall 42*b*. Since the inner insulating portion 45 can be formed on the inner surface 426*b* of the bottom wall 42*b* by simply filling the fill space K5 with molten plastic, the inner insulating portion 45 can be formed easily.

(7) The flange portions 423*b* are formed on and protrude from the outer surface 425*b* of the bottom wall 42*b*. Each flange portion 423*b* is formed on the periphery of one of the bolt insertion holes 421*b*. That is, with the flange portions 423*b*, the thickness of the metal plate 42 at the periphery of each bolt insertion hole 421*b* is greater than the thickness of the other parts of the metal plate 42. This increases the strength of the peripheries of the bolt insertion holes 421*b*. Therefore, when the threaded portion 51*a* of each bolt 51 is threaded into the corresponding internal thread hole 121*c*, the flange portion 423*b* can withstand the load applied to the metal plate 42 via the head 51*b*, which improves the strength of the metal plate 42.

The above embodiment may be modified as follows.

Figure 5:
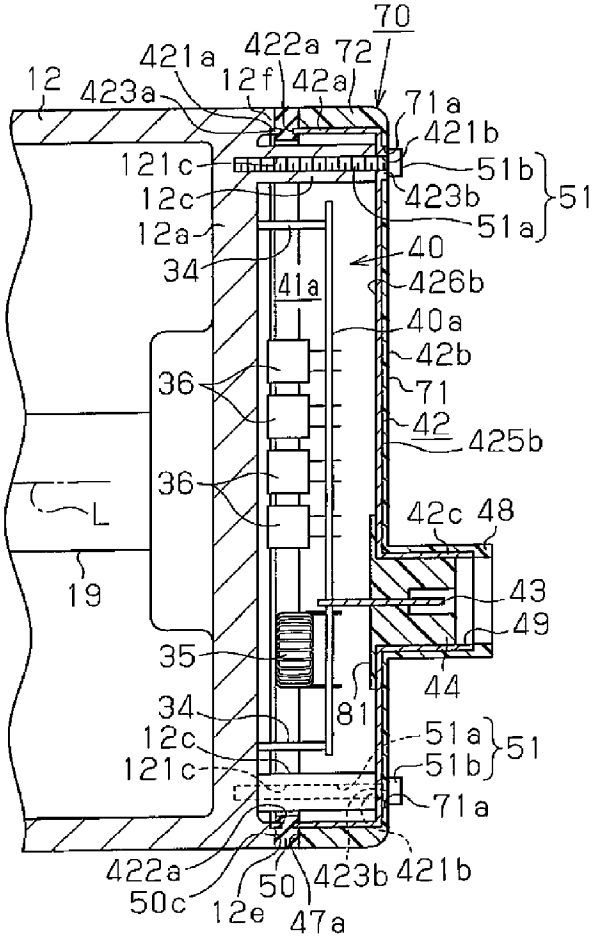
FIG. 5 is a partially enlarged cross-sectional view illustrating an inverter and its surroundings according to another embodiment.

An inverter cover 70 according to an embodiment shown in FIG. 5 may be used, in which a plastic outer insulating portion 71 is formed along the outer surface 425*b* of the bottom wall 42*b* of the metal plate 42. The outer insulating portion 71 is formed integrally with and continuous with the insulating cover 48. The inverter cover 70 also has an outer circumferential insulating portion 72, which is continuous with the outer insulating portion 71 and extends along the outer circumferential portion 42*a*. Through holes 71*a* are formed in the outer insulating portion 71 at positions corresponding to the flange portions 423*b*, and the end faces of the flange portions 423*b* face outward through the through holes 71*a*. In this configuration, the outer surface 425*b* of the bottom wall 42*b* of the metal plate 42 is covered with the outer insulating portion 71, which improves the corrosion resistance of the metal plate 42.

As shown in FIG. 5, an inner insulating portion 81 may be formed only about the metal terminal 43 in the inverter cover 70. Since the metal terminal 43 receives high voltage from an external power source, the metal terminal 43 requires a high level of insulation. Therefore, by providing the inner insulating portion 81 particularly about the metal terminal 43, the insulation of the metal terminal 43 can be improved.

Figure 6:
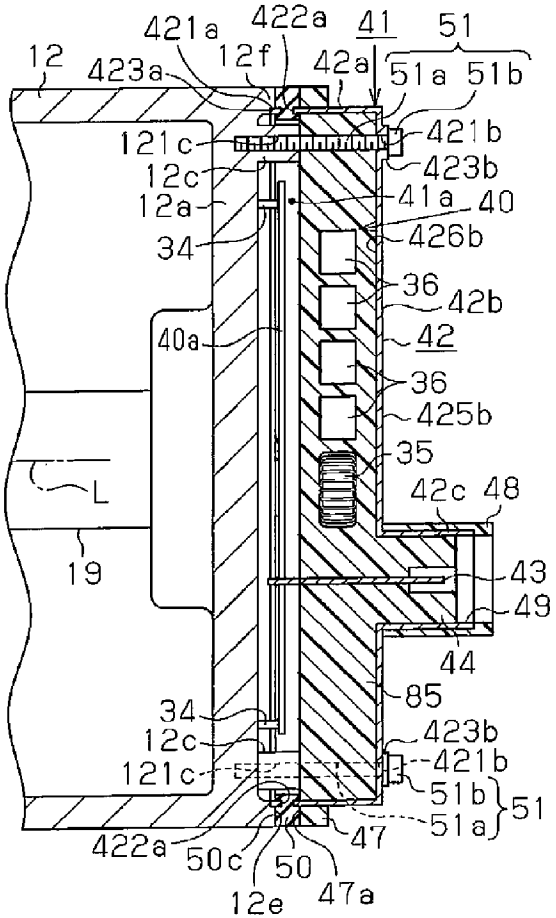
FIG. 6 is a partially enlarged cross-sectional view illustrating an inverter and its surroundings according to another embodiment.

As in an embodiment shown in FIG. 6, the filter coil 35 and the capacitors 36 may be integrated with an inner insulating portion 85 in a mold. The filter coil 35 and the capacitors 36 are electrically connected to the circuit board 40*a* via a bus bar (not shown) incorporated in the inner insulating portion 85. This improves the electrical insulation of the filter coil 35 and the capacitors 36. Since the capacitors 36 are not mounted on the mounting surface of the circuit board 40*a*, the size of the circuit board 40*a* can be reduced compared to a case in which the capacitors 36 are mounted on the mounting surface of the circuit board 40*a*.

Figure 7:
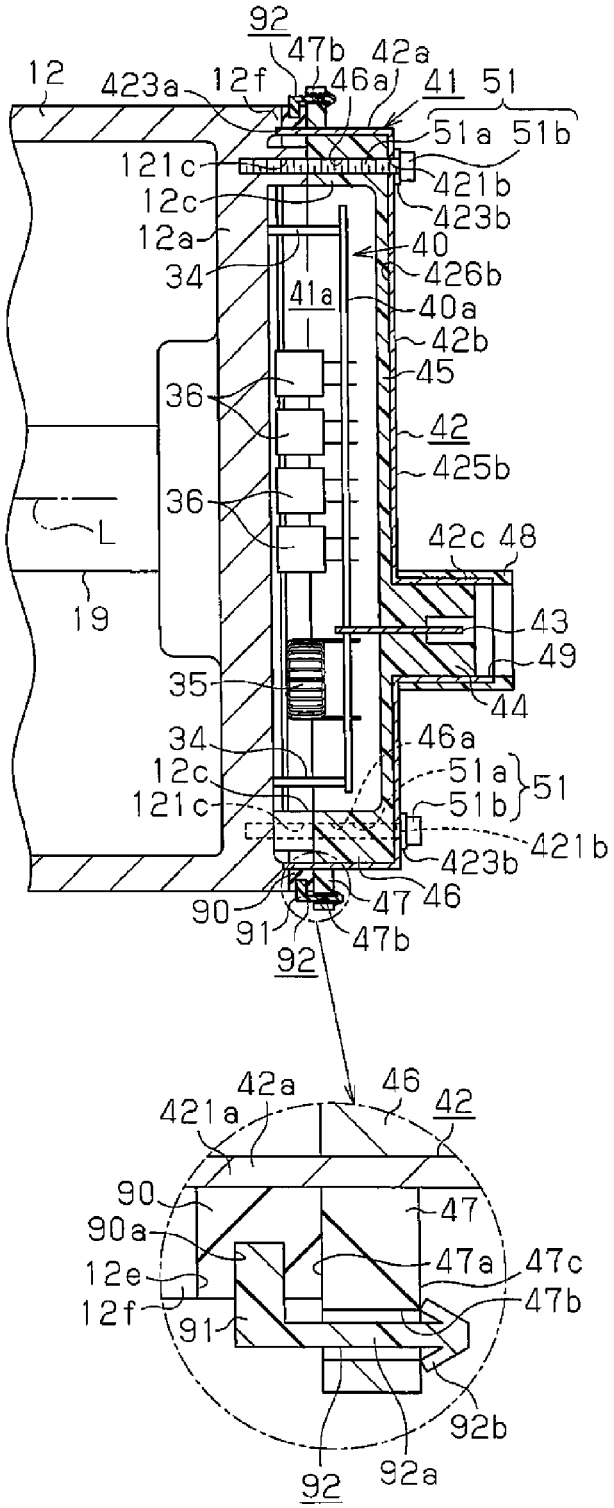
FIG. 7 is a partially enlarged cross-sectional view illustrating an inverter and its surroundings according to another embodiment.

In the embodiment, the sealing member 50 does not need to be integrated with the metal plate 42. As shown in FIG. 7, an annular sealing member 90 may be arranged between the end face 47*a* of the outer circumferential insulating portion 47 and the end face 12*e* of the rim 12*f*. The sealing member 90 has a fitting groove 90*a*, which extends along the entire outer circumferential surface. A plastic annular ring 91 is fitted in the fitting groove 90*a*. The annular ring 91 has a plurality of plastic engaging pins 92 (only two of them are shown in FIG. 7) formed on the outer circumferential edge. The engaging pins 92 extend in the axial direction of the rotary shaft 19 and are arranged in the circumferential direction of the annular ring 91 at predetermined intervals. Each engaging pin 92 is formed by an extended portion 92*a*, which extends in the axial direction of the rotary shaft 19, and an engaging portion 92*b*. The engaging portion 92*b* extends from the distal end of the extended portion 92*a* toward the proximal end of the extended portion 92*a* in a manner separating from the extended portion 92*a*. Each engaging portions 92*b* is elastically deformable at the proximal end to approach and move away from the extended portion 92*a*. Also, the outer circumferential insulating portion 47 has insertion holes 47*b* (only two of them are shown in FIG. 7), which are arranged at predetermined intervals in the circumferential direction.

When engaging portions 92*b* are forcibly inserted into the insertion holes 47*b* of the outer circumferential insulating portion 47 from the end face 47*a*, the engaging portions 92*b* are passed through the insertion holes 47*b* while being elastically deformed toward the extended portions 92*a*. After being passed through the insertion holes 47*b*, the engaging portions 92*b* restore the original shape, and the distal ends of the engaging portions 92*b* are engaged with the end face 47*c* of the outer circumferential insulating portion 47. The sealing member 90 is thus assembled to the outer circumferential insulating portion 47 by means of the engaging pins 92 and the annular ring 91. In this manner, the sealing member 90 may be integrated with the outer circumferential insulating portion 47.

Figure 8:
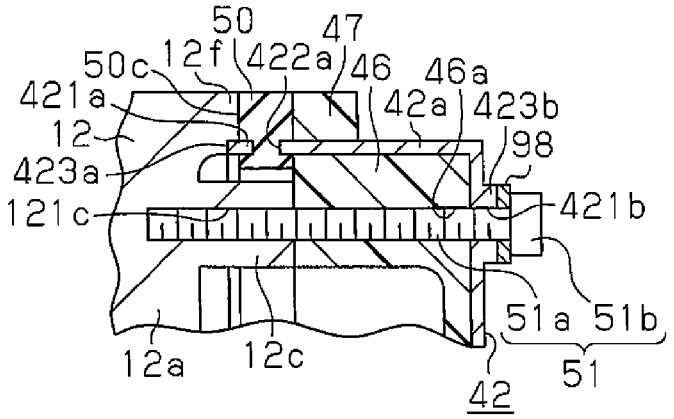
FIG. 8 is an enlarged cross-sectional view illustrating a bolt insertion hole and its surroundings according to another embodiment.

In the embodiment, a metal collar 98 may be placed between the head 51*b* of each bolt 51 and the corresponding flange portion 423*b* as shown in FIG. 8. In this case, the head 51*b* of each bolt 51 and the end face of the corresponding flange portion 423*b* are electrically connected to each other by the collar 98.

In the embodiment, the sealing member 50 is integrated with the metal plate 42. However, a sealing member alone may be placed between the suction housing member 12 and the inverter cover 41.

In the embodiment, the inner insulating portion 45 is formed to extend from the power connector 44 and along the inner surface 426*b* of the bottom wall 42*b* of the metal plate 42. However, the structure is not limited to this. For example, in a case in which the capacitors 36 are mounted on the mounting surface of the circuit board 40*a* that faces the bottom wall 42*b*, an inner insulating portion may be provided on a part of the inner surface 426*b* of the bottom wall 42*b* that faces the capacitors 36 to ensure insulation between the capacitors 36 and the bottom wall 42*b*. In this case, the inverter cover 41 preferably has an outer insulating portion 71 shown in FIG. 5.

In the embodiment, an inner insulating portion may be provided only on a part of the inner surface 426*b* of the bottom wall 42*b* that faces the circuit board 40*a*. In this case, the inverter cover 41 preferably has an outer insulating portion 71 shown in FIG. 5.

In the embodiment, an inner insulating portion may be provided only on a part of the inner surface 426*b* of the bottom wall 42*b* that faces the filter coil 35. In this case, the inverter cover 41 preferably has an outer insulating portion 71 shown in FIG. 5.

In the embodiment, an inner insulating portion may be provided only on a part of the inner surface 426*b* of the bottom wall 42*b* that faces the switching elements. In this case, the inverter cover 41 preferably has an outer insulating portion 71 shown in FIG. 5.

In the embodiment, the metal plate 42 is formed of aluminum. However, the metal plate 42 may be formed, for example, of iron or copper.

In the embodiment, the sealing member 50 is assembled with the metal plate 42 by engaging the engaging portions 50*b* with the edges of the sealing member attaching holes 422*a*. However, the sealing member 50 may be molded integrally with the metal plate 42.

In the embodiment, the flange portions 423*b*, which protrude from the outer surface 425*b* of the bottom wall 42*b*, do not need to be formed about the bolt insertion holes 421*b*.

In the embodiment, the distal surface 423*a* of the outer circumferential portion 42*a* does not need to contact the recess 121*f* formed in the inner circumference of the rim 12*f*.

In the embodiment, the distal surface 423*a* of the outer circumferential portion 42*a* does not need to protrude further than the end face 50*c* of the sealing member 50, which faces the suction housing member 12.

In the embodiment, the compressing portion 15 is not limited to a type formed by a stationary scroll and a movable scroll, but may be, for example, a piston type or a vane type.

Therefore, the present examples and embodiments are to be considered as illustrative and not restrictive and the invention is not to be limited to the details given herein, but may be modified within the scope and equivalence of the appended claims.

The invention claimed is:

1. An electric compressor comprising:

a metal housing;

a compressing portion and an electric motor accommodated in the housing;

an inverter for driving the electric motor; and an inverter cover fixed to the housing, the inverter cover accommodates the inverter, wherein the inverter cover has a metal plate that is arranged to cover the inverter, the metal plate has a bolt insertion hole for fixing the inverter cover to the housing, when the inverter cover is fixed to the housing by a metal bolt having a head and a threaded portion, the threaded portion of the bolt is passed through the bolt insertion hole, and the head of the bolt and the periphery of the bolt insertion hole are electrically connected to each other, and the inverter cover is formed of plastic by being molded in a mold, using the metal plate as a core, and a sealing member for sealing a space between the housing and the inverter cover, wherein the sealing member has an end face that faces the housing, the metal plate is exposed from the plastic and has an annular end portion that faces the housing, the end portion having a distal surface, and when the inverter cover is fixed to the housing, the sealing member covers part of the end portion of the metal plate, and the distal surface of the end portion of the metal plate protrudes further toward the housing than the end face of the sealing member.

2. The electric compressor according to claim 1, wherein the end portion of the metal plate and the sealing member are formed integrally.

3. The electric compressor according to claim 1, wherein the end portion of the metal plate contacts the housing.

4. The electric compressor according to claim 1, wherein the metal plate has an inner surface that faces the inverter, the inverter cover has a plastic power connector integrated therewith, the power connector having a metal terminal electrically connectable with an external power source, and an inner insulating portion is formed to extend from the power connector and along the inner surface of the metal plate.

5. The electric compressor according to claim 1, wherein the metal plate has an outer surface located opposite to the inverter cover, an outer insulating portion is formed on the inverter, and the outer insulating portion extends along the outer surface of the metal plate.

6. The electric compressor according to claim 1, wherein the thickness of the metal plate at the periphery of the bolt insertion hole is greater than the thickness of a part of the metal plate at locations other than the periphery of the bolt insertion hole.

7. The electric compressor according to claim 1, wherein a metal collar is placed between the head of the bolt and the periphery of the bolt insertion hole.

8. The electric compressor according to claim 1, further comprising:

a rotor that is a part of the electric motor; and a rotary shaft that rotates integrally with the rotor, wherein the rotor and the rotary shaft are accommodated in the housing, and the compressing portion, the electric motor, and the inverter are arranged in order in the axial direction of the rotary shaft.

9. The electric compressor according to claim 1, wherein the metal plate shields the inverter against external electromagnetic noise.

* * * * *